US005203828A

United States Patent [19]

Strain

[11] Patent Number: 5,203,828

[45] Date of Patent: Apr. 20, 1993

[54] GUIDE AND CONTROL MEANS FOR DIAPHRAGM

[76] Inventor: Patrick J. Strain, 27 Tanglewood Dr., Nepean, Ontario, Canada, K2H 6P5

[21] Appl. No.: 706,855

[22] Filed: May 29, 1991

[51] Int. Cl.[5] ..... B63B 25/12

[52] U.S. Cl. ..... 114/74 R; 220/505; 220/564

[58] Field of Search ..... 114/72-74; 137/172, 564.5; 220/505, 530, 564, 221, 222

[56] References Cited

U.S. PATENT DOCUMENTS

| | | | |
|---|---|---|---|
| 2,696,185 | 12/1954 | Snoddy | 220/530 |
| 4,286,726 | 9/1981 | Madsen | 220/222 |
| 4,449,543 | 5/1984 | Green, Jr. | 137/564.5 |
| 4,478,165 | 10/1984 | Strain | 114/74 R |
| 4,705,185 | 11/1987 | Barbillat | 220/222 |

*Primary Examiner*—Edwin L. Swinehart

*Attorney, Agent, or Firm*—Burke-Robertson

[57] ABSTRACT

Relocation of the guide and control system for a seawater ballast/cargo oil, horizontal separation diaphragm, from the lower portion of the cargo tank of an oil tanker to the main deck level, with a corresponding increase in the length of the diaphragm membrane and the guide cylinder, thereby allowing the diaphragm full travel from top to bottom of the tank and vice versa. This relocation enables the total volume of the cargo tank to be utilized for the carriage of two different liquids, at different times, without cross-contamination occurring between the cargo being carried and any residue remaining at in the tank from the previous cargo e.g. a marine very large crude oil carrier (VLCC) fitted with a diaphragm in each of its cargo tanks, could carry a full cargo of crude oil from the Arabian Gulf to Europe or Japan and return with a full cargo of fresh water for industrial or agricultural use.

7 Claims, 3 Drawing Sheets

GUIDE AND CONTROL MEANS FOR DIAPHRAGM

BACKGROUND OF THE INVENTION

The subject invention is an improvement in the art disclosed in the inventor's U.S. Pat. Nos. 4,117,796 and 4,478,165.

The field of the invention relates to machinery and tankage for the carriage, in marine oil tankers, of water ballast and liquid cargos, including slurries, without cross-contamination of substances, even if the tankage has not been cleaned. It will be noted that some marine oil tankers are very large and have correspondingly large ballast and cargo tanks.

In the prior art mentioned in the foregoing, the special guidance and control machinery are located in the lower portion of the oil cargo tanks. This location gives rise to certain disadvantages with regards to the total volume of liquid that can be carried in the tanker. These disadvantages are overcome by the subject invention.

DESCRIPTION OF THE PRIOR ART

U.S. Pat. No. 4,117,796 of Strain, issued Oct. 3, 1978, discloses diaphragms fitted in the lower portion of ships cargo tanks above the "double-bottom" space, thus allowing for the carriage of oil and water ballast at different times in the same "cargo space", without any cross-contamination. Main objectives of the invention are to increase the cargo and ballast carrying efficiencies of tanks so fitted, while at the same time protecting the marine environment from pollution.

U.S. Pat. No. 4,478,165, of Strain, issued Oct. 23, 1984, discloses a plurality of narrow ballast tanks which are located around the periphery of horizontal diaphragms. All of the diaphragms are located in the lower portion of the cargo tanks. The main objective is to provide a receptive and protective "cell" for each diaphragm.

U.S. Pat. No. 4,178,868, of Iizuka et al, issued Dec. 18, 1979, discloses a flexible membrane which is vertically fitted in such manner that the tank can carry either seawater ballast or oil cargo without cross-contamination. The main objective of the invention appears to be to overcome the high stresses induced in the membrane of a similar prior art system referred to in the Iizuka et al patent. A problem with the totally flexible membrane is that care must be taken to keep the tank completely full or empty when at sea, in order to avoid the potentially dangerous "free surface effect" of liquid sloshing about in the tanks. Other problems include the large amount of membrane involved and the lack of means for its control. This can cause trouble during the cargo stripping operation, as a large volume of cargo oil can be entrapped in the loose folds of membrane material that have fallen to the bottom of the cargo tank.

U.S. Pat. No. 4,228,754, Shibata et al issued Oct. 21, 1980 points out one of the pitfalls, encountered when dividing a tank by the use of a completely flexible membrane i.e. the membrane is difficult to control and will be inclined to block the pipe openings during transfer operation. Shibata et al teaches long grid-plates suitably located over the tank gutters in order to provide protection for the pipe openings.

U.S. Pat. No. 4,060,175, Rysgaard Sr., issued Nov. 27, 1977, shows a diaphragm for a waste water anaerobic digester. The purpose of the diaphragm is to regulate the gas pressure in the space between the top of the sludge that is being digested and the bottom of the diaphragm membrane. Control of the gas pressure is effected by means of a weighted ballast, such as glass beads or sand, which is poured directly onto the top of the diaphragm membrane. The patent specifically mentions (page 3, lines 31–35) that free-flowing liquids are not suitable substances for use as ballast.

U.S. Pat. No. 4,484,533, David, issued Nov. 27, 1984, describes a system whereby a flexible bag takes the shape of an inner tank located in the cargo tank of an oil tanker. The inner tank is in liquid communication with the surrounding cargo tank. In the tanker's "oil cargo" condition, the flexible bag is stowed against the top of the inner tank, and both the cargo tank and the inner tank are filled with oil. In the tanker "water cargo" condition, the flexible bag is filled with potable water and the cargo tank is filled with non-potable water.

It is an object of the present invention to allow full use to be made at all times of the total tank space between a tanker's main deck and the top of the bottom framing of the ship. This will allow for the carriage of fluid cargo, fresh water ballast, or seawater ballast above the diaphragm when it is in its lowest position and seawater ballast, fresh water ballast or fluid cargo in the same diaphragm cell space but below the diaphragm when the diaphragm is in its highest position.

SUMMARY OF THE INVENTION

The present invention relates to an improvement for a diaphragm tank of the type having an impervious diaphragm vertically movable between upper and lower positions within the tank. The improvement comprises a diaphragm guide cylinder means secured to an upper surface of the diaphragm. The diaphragm guide cylinder extends upwardly through a gland means located at the top of the tank to prevent escape of fluid stored in the tank and circumscribing the guide cylinder and tank through guide and brake means located externally of the tank.

The change in location of the diaphragm guide and control equipment, due to the increased scope for diaphragm vertical travel, allows almost all of the "cargo" tank to be used for the carriage of segregated seawater ballast without contamination even if the tank has not been cleaned, or for the carriage of an alternative liquid cargo. e.g. fresh water could be carried in the space beneath the diaphragm. This would allow the tanker to carry a full cargo of oil, for example, from the Arabian Gulf to Europe, Japan or the U.S.A. and return with a full cargo of fresh water for industrial or agricultural purposes. A full cargo in each direction would obviously greatly increase a tanker's commercial viability. Slurried cargo could also be carried in the cell space beneath the diaphragm, provided special equipment is supplied to handle the slurry.

Location of the diaphragm guide and control equipment at or above main deck level also allows for easier inspection and maintenance of the mechanism, as compared to their being located in the lower portion of a cargo tank that has contained oil.

BRIEF DESCRIPTION OF THE DRAWINGS

To maintain simplicity, various conventional features that are essential to the safe and efficient operation of the diaphragms of the present invention (e.g. detailed joining arrangements of the diaphragm membrane to the sides of the cargo tank and to the diaphragm partition plating) that have already been disclosed in U.S. Pat. No. 4,117,796 and 4,478,165, are not repeated in the following drawings. However, it will be understood that these various features are integral to the following drawings and will be included as necessary when the disclosures of the drawings are transmitted into practice.

Also, although the drawings and description only refer to diaphragms fitted in marine tanks, it is obvious that tne scope of the invention includes other tanks used for the carriage and storage of fluids and slurries, such as those used in land, road, rail and aerospace practice.

Figure 1:
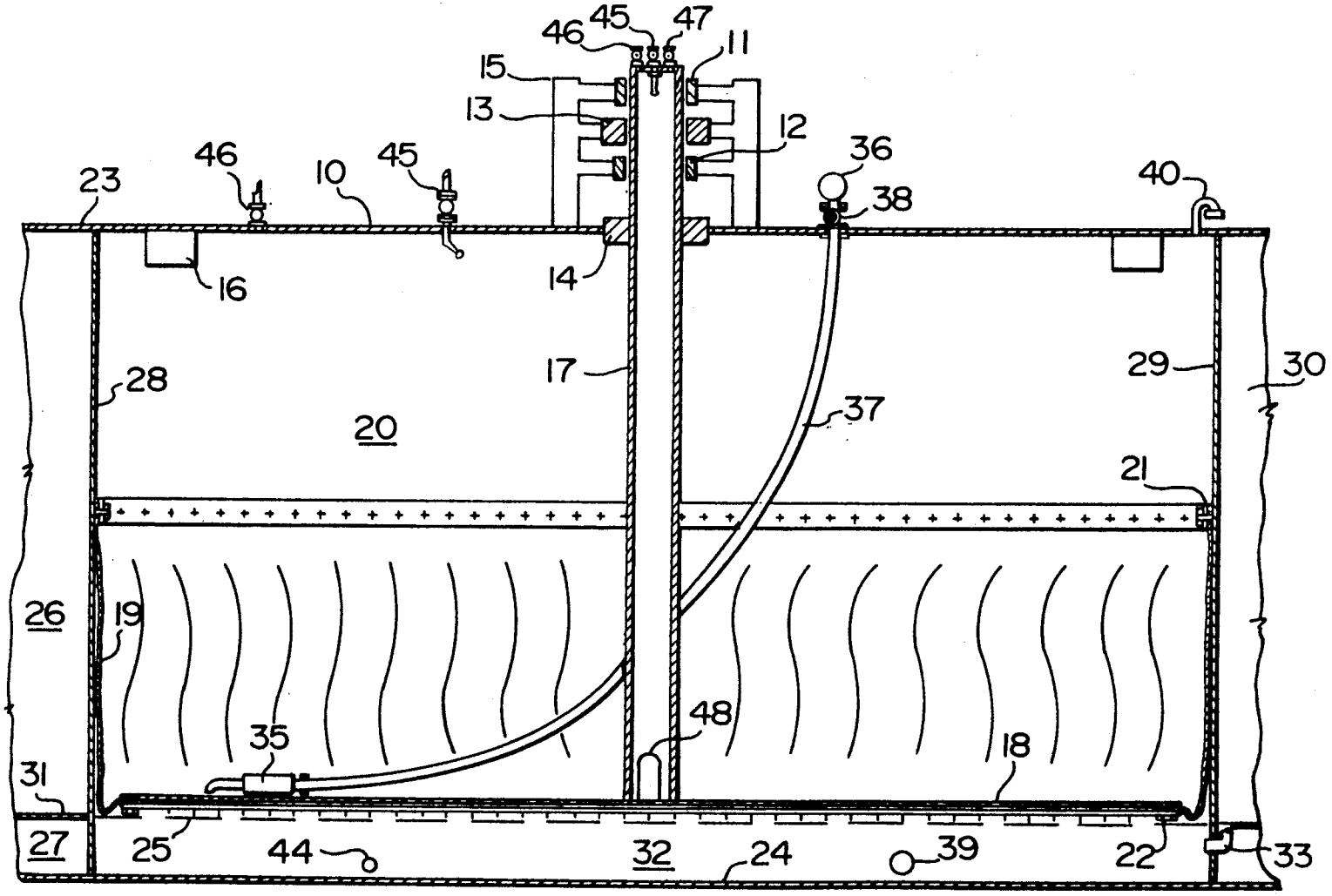

These and other objects and advantages of the invention will become apparent upon reading the following detailed description and upon referring to the drawings in which:

FIG. 1 is a transverse cross-section of a center cargo tank with "double bottom" space arrangement, for a marine oil tanker that is fitted with the improvement invention.

Figure 2:
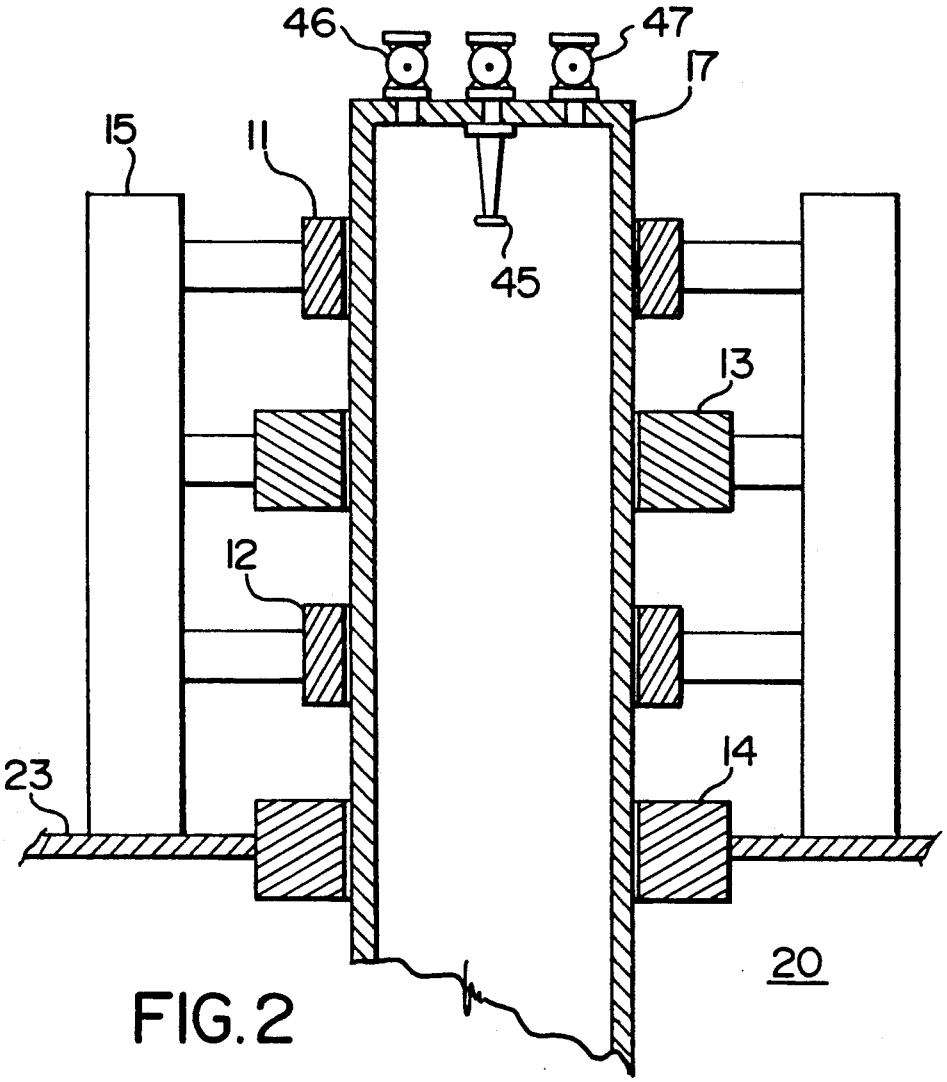

FIG. 2 is a transverse cross-sectional drawing of the main portion of the improvement invention, which is located about the main deck level.

Figure 3:
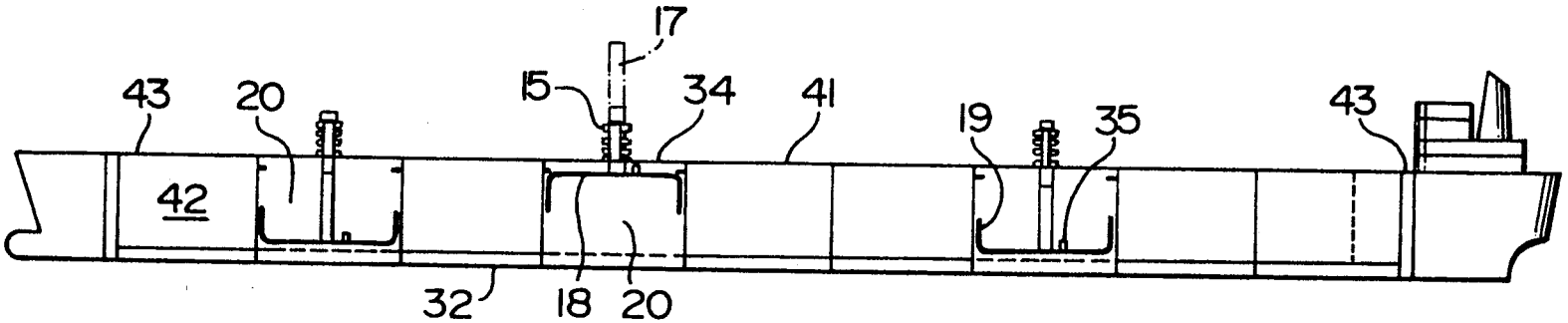

FIG. 3 is a longitudinal cross-section of a large oil tanker that has the improvement invention fitted to three cargo tanks.

While the invention will be described in conjunction with example embodiments, it will be understood that it is not intended to limit the invention to such embodiments. On the contrary, it is intended to cover all alternatives, modifications and equivalents as may be included within the spirit and scope of the invention as defined by the appended claims.

For reasons of clarity, emphasis throughout this detailed description will be placed on the invention as applied to marine oil tankers, but it will be understood that the invention, with slight and obvious modification is also suitable for use in other types of ships, and for use in tanks used in industries other than the shipping industry.

Also should the shipowner so wish, with slight and obvious modification the subject apparatus can be placed in the side of a tank, i.e. with the movable partition in a vertical position.

Cargo and ballast tank cleaning arrangements are conventional and are not depicted or described. Where appropriate, a crude oil washing system, in association with an inert gas system, can be fitted. Special safety arrangements are shown.

DETAILED DESCRIPTION OF THE INVENTION

In the drawings, similar features have been given similar reference numerals.

Referring to the drawing figures, improvement parts are:

Referring to the drawing figures, improvement parts are:

| Part No. | Part |
|---|---|
| 10 | Center cargo tank |
| 11 | Top guide bearing |
| 12 | Bottom guide bearing |
| 13 | Diaphragm emergency brake |
| 14 | Deck gland |
| 15 | Trestle |
| 16 | Diaphragm stop |
| 17 | Diaphragm guide cylinder |
| 18 | Diaphragm partition plating |
| 19 | Diaphragm membrane |

-continued

| | |
|---|---|
| 20 | Diaphragm cell space |
| 35 | Submersible pump |
| 37 | Flexible hose |
| 45 | Cargo oil washing nozzle |
| 46 | Guide inert gas valve |
| 47 | Guide vent pipe |
| 48 | Guide access opening |

Conventional parts are:

| Part No. | Part |
|---|---|
| 21 | Bulkhead/membrane seal |
| 22 | Partition/membrane seal |
| 23 | Main deck |
| 24 | Bottom plating |
| 25 | Top of bottom frame |
| 26 | Port wing cargo tank |
| 27 | Port wing double bottom tank |
| 28 | Port longitudinal bulkhead |
| 29 | Starboard longitudinal bulkhead |
| 30 | Starboard wing cargo tank |
| 31 | Double bottom tank top |
| 32 | Diaphragm "double bottom" space |
| 33 | Ballast space vent pipe |
| 34 | Cargo tank No. 4 |
| 36 | Cargo deck main |
| 38 | Cargo valve |
| 39 | Ballast main |
| 40 | Oil space vent pipe |
| 41 | Oil tanker |
| 42 | Cargo tank |
| 43 | Cofferdam |
| 44 | Emergency oil discharge pipe |

FIG. 1 shows the No. 2 center "cargo" tank 10 of an oil tanker 41 (FIG. 3), in which a deck gland 14 is fitted in the tanker's main deck 23. A steel trestle 15 is attached to the main deck 23. The trestle 15 supports top guide bearing 11, bottom guide bearing 12 and diaphragm emergency brake 13, which are centrally located directly above the deck gland 14.

Movable diaphragm partition plating 18 is laid horizontally across the top of the ship's bottom framing 25. Suitable clearance is allowed between the ends and sides of the diaphragm partition plating 18 and the surrounding bulkheads of the diaphragm cell space 20.

The end of a lengthened (in comparison with the prior art disclosed in U.S. Pat. Nos. 4,117,796 and 4,478,165) diaphragm guide cylinder 17 is passed through the top guide bearing 11, diaphragm emergency brake 13, bottom guide bearing 12, deck gland 14, and is centrally located and attached to the top of the diaphragm partition plating 18, the arrangement providing guidance and control means for vertical movement of the diaphragm partition plating 18.

One end of the diaphragm membrane 19 is attached to the periphery of the diaphragm partition plating 18 by the partition/membrane seal 22. The other end of the diaphragm membrane 19 is attached all around by the bulkhead/membrane seal 21, at diaphragm cell space 20 mid-height position, to the cell bulkheads, including port longitudinal bulkhead 28 and starboard longitudinal bulkhead 29.

Deck gland 14 prevents the escape of oil to the atmosphere, at main deck 23 level when the diaphragm cell space 20 is fitted with cargo oil. It also prevents the ingress of water from the top of the main deck 23 into the diaphragm cell space 20.

A submersible pump 35 is attached to the top of the diaphragm partition plating 18. A reinforced flexible hose 37 connects the discharge outlet from the submersible pump 35 to the cargo deck main 36. The length of the flexible hose 37 is such that there is slack in the hose at all times.

Submersible pump 35 and flexible hose 37 are constructed, with appropriate valving, so that cargo liquid can be loaded by reverse flow through hose 37 and then through submersible pump 35, into cell space 20.

Diaphragm stoppers 16 are provided to limit the upper travel of the diaphragm partition plating 18. Lower travel of the diaphragm partition plating 18 is limited by the tops of the bottom frames 25. The diaphragm stoppers 16 are attached to the underpart of the main deck 23 of the tanker and are dimensioned to allow for stowage of the submersible pump 35 and flexible hose 37 when the diaphragm cell space 20 below the diaphragm partition plating 18 is filled with ballast water, i.e. when the diaphragm is in its top position.

A ballast space vent pipe 33, and an oil space vent pipe 40 are also provided.

Top guide bearing 11, bottom guide bearing 12 diaphragm emergency brake 13, submersible pump 35 and flexible hose 37 are standard items that can be obtained from shipyard suppliers. The other parts, with the exception of diaphragm membrane 19, can be constructed by the shipyard or obtained from the shipyard suppliers in the normal manner.

The diaphragm membrane 19, is a NYLON or KEVLAR based reinforced elastomeric fabric, which is coated on either side with a neoprene or nitrile type substance that is compatible with the cargo or ballast with which it comes into contact. The diaphragm membrane 19 is preferably manufactured, installed and maintained by a firm with strong experience in the rubber-/elastomeric industry.

The tankage contiguous to diaphragm cell space 20, e.g. both port wing cargo tank 26 and starboard wing cargo tank 30, can be conventional as depicted or can also be fitted with diaphragms. If diaphragms are not fitted, the port wing double bottom tank 27 and double bottom tank top 31 will be conventional. If diaphragms are fitted in the port wing cargo tank 26 and starboard wing cargo tank 30, then the double tank top 31 can be deleted. In this case, should there be grounding damage to the tanker's bottom plating 24 causing breaching of the diaphragm "double bottom" space 32, the diaphragm will, in effect, become the inner bottom of the tanker until the breach is repaired.

FIG. 2 shows the re-location of the diaphragm guide and control means in a clearer format. It will be understood that top guide bearing 11, bottom guide bearing 12, diaphragm emergency brake 13 and deck gland 14, being "off-the-shelf" items, may take various forms, to the shipowner's specifications, provided adequate diaphragm guide and control means are maintained.

The diaphragm guide cylinder 17 can be fitted with a guide cargo oil washing nozzle 45, guide inert gas valve 46, guide vent pipe 47, and guide access opening 48 (FIG. 1). This will allow the interior of the diaphragm guide cylinder to be operated and maintained for the carriage of cargo.

FIG. 3 depicts an oil tanker 41 having nine cargo tanks 42, only three of which, are fitted with diaphragms. These three diaphragms have the increased travel capacity of the subject invention. The other cargo tanks 42 in this particular tanker are not fitted with diaphragms and have conventional double bottom tanks 27 located beneath the conventional cargo tanks 42.

Having the three "cargo tanks" fitted with diaphragms allows the captain of this particular tanker, when the ship is in the ballast condition, to avoid having to put non-segregated seawater ballast into some of the conventional cargo tanks 42, thereby averting a potential threat to the marine environment through the subsequent discharge into the sea of oil-contaminated ballast water.

An example of how the system could be operated in practice will now be described in detail.

Assume that the vessel depicted in FIG. 3 is a 250,000 DWt (deadweight tonnes) VLCC (very large crude oil carrier) having a double hull and cofferdams 43. Instead of having diaphragms in only three cargo tanks as shown, it is fitted with a diaphragm in each cargo tank.

Also assume that the diaphragm cell space 20 that is above the diaphragm partition plating 18 is suitable for the carriage of crude oil, and the diaphragm cell space 20 that is below the diaphragm partition plating 18 is suitable for the carriage of fresh water of a quality that will allow it to be used for agricultural or industrial purposes.

Finally assume that the vessel is chartered for a round voyage from the Arabian Gulf to Europe or Japan.

Having arrived at the oil terminal in the Arabian Gulf with all diaphragms in the lowered position, i.e. with the diaphragm partition plating 18 resting on the tops of the bottom frames 25, as depicted for Nos. 2 and 7 diaphragm cell spaces of FIG. 3, crude oil is loaded in the conventional manner into the diaphragm cell spaces 20, above the diaphragm partition plates 18, until the spaces are 98 per cent full as normally recommended. Loading is then stopped.

The vessel then proceeds to Europe or Japan, as directed. While the VLCC is at sea the diaphgram "double bottom" spaces 32 are checked to ensure that there is no leakage of cargo oil past the diaphragms. While leakage is not expected, if any does occur, the normally blocked-off emergency small emergency discharge oil pipe 44 system should be activated and the oil in the diaphragm "double bottom" space 32 should be pumped back into its diaphragm cell space 20 or to other suitable tankage. The leak should be repaired at the first opportunity.

Before arriving at the oil discharge terminal, each diaphragm system is checked to ensure that is has not been damaged by the motion of the vessel and is in perfect working order. The routine inspection would include:

- Examination of the deck gland 14, to ensure that there is no cargo oil leakage.
- Checking the top guide bearing 11 and the bottom guide bearing 12, to ensure that there is freedom of movement for the diaphragm guide cylinder 17.
- Operating the diaphragm emergency brake 13, to ensure its availability if required.
- Checking diaphragm "double bottom" space 32 to ensure that there is no oil leakage past the diaphgram.

During the unloading operation at the oil discharge terminal a conventional cargo oil washing nozzle 45 system can be used.

Following discharge of cargo, the diaphragm emergency brakes 13 are checked, to ensure that they are unlocked. The ballast space vent pipes 33 are carefully checked, to ensure that they are not restricted or blocked. Fresh water can now be introduced into the diaphragm "double bottom" space 32. As the fresh water rises, air in the space is vented in the ballast space vent pipe 33. As the fresh water reaches the bottom of the diaphragm partition plating 18 it starts to rise and the diaphragm membrane 19 "balloons" inward but is brought back to the flattened-to-bulkhead 28, 29, condition. As the diaphragm partition plating 18 reaches the diaphragm stops 16, the reverse side of the diaphragm membrane 19 will be facing the center of the diaphragm partition plating 18.

As the partition plating 18 approaches the diaphragm stops 16, the fresh water pump is slowed and finally is stopped or switched to the next diaphragm cell space 20 before or upon metal-to-metal contact being made.

Except for the storage space for the submersible pump 35 and flexible hose 37, i.e., the space between the top of the diaphragm partition plating 18 when in its top position and the underside of the main deck 23, the diaphragm cell space 20 is now completely filled with fresh water.

When all of the diaphragm cell spaces 20 have been filled with fresh water, the tanker can start on its return voyage to the Arabian Gulf terminal. While the tanker is at sea it may be advantageous to leave the diaphragm emergency brakes 13 in the unlocked position, in order to allow the diaphragm partition platings 18 to float freely on the top of the freshwater cargo. The weight of the diaphragm partition platings 18 will help to dampen any sloshing of the cargo and reduce the risk of structural damage. Also, the vertical movement of the diaphragm partition platings 18 will help to alleviate any stresses in the diaphragm membrane 19 caused by hull structure movement due to heavy weather conditions.

Upon arrival at the Arabian Gulf terminal the fresh water is pumped out of each diaphragm cell space 20, leaving the diaphragm partition platings 18 again resting on the tops of the bottom frames 25, thereby completing the overall voyage cycle.

As the fresh water is pumped out of each diaphragm cell space 20, the diaphragm partition plating 18 slowly lowers until finally it is again resting on the tops of the bottom frames 25. As the fresh water is being pumped ashore, it is checked to ensure that is has not been contaminated by oil residues from the previous cargo. Although not anticipated in practice, any trace of oil residue from the previous cargo would indicate diaphragm leakage. The source of this leakage should be located and immediate repairs carried out.

When the last of the fresh water has been pumped ashore from the diaphragm double bottom space 32, the overall system is again checked before starting to load the next cargo, thereby completing the cargo operations cycle.

In lieu of the foregoing, in which liquid cargo is carried in the diaphragm cell space 20, when the diaphragm partition plating 18 is in its lowest position provided suitable conventional cargo hold hatch covers are fitted in the main deck 23 and other conventional cargo handling and stowage means are provided as necessary, then bulk, slurried, containers or general cargo, such as grain, slurried coal or automobiles, can be carried in the diaphragm cell space 20.

While certain novel features of my invention have been shown and described and are pointed out in the appended claims, it will be understood that various substitutions, omissions and changes in the form and details of the device illustrated and in its operation can be made by those skilled in the art without departing from the spirit of the invention. Therefore what has been set forth is intended to describe and/or illustrate such concept and is not for limited protection to any herein particularly described embodiment thereof.

What I claim as my invention:

1. In a diaphragm tank having walls and an impervious diaphragm vertically movable between upper and lower positions within the tank, the diaphragm comprising a diaphragm partition having edges to which are secured an edge of a diaphragm membrane, another edge of the diaphragm membrane being secured to the walls of the tank, so as to prevent cross contamination of cargos within the tank from one side of the diaphragm to the other, the improvement comprising diaphragm guide cylinder means secured to an upper surface of the diaphragm and extending upwardly beyond the tank through guide and brake means located externally of the tank, and through gland means at the top of the tank circumscribing the guide cylinder means below the guide and brake means to prevent escape of fluid stored in the tank.

2. Apparatus according to claim 1 wherein the guide means comprises bearing means.

3. Apparatus according to claim wherein the diaphragm comprises a rigid central partition circumscribed by a flexible membrane extending between it and a central portion of circumscribing walls of the tank, the membrane being of a size to accommodate the vertical travel of the diaphragm.

4. In a diaphragm tank having an impervious diaphragm vertically movable between upper and lower positions within the tank, the improvement comprising a diaphragm guide cylinder means secured to an upper surface of the diaphragm and extending upwardly beyond the tank through guide and brake means located externally of the tank, and through gland means at the top of the tank circumscribing the guide cylinder means below the guide and brake means to prevent escape of fluid stored in the tank, the diaphragm comprising a rigid central partition circumscribed by a flexible membrane extending between it and a central portion of the circumscribing walls of the tank, the membrane being of a size to accommodate the vertical travel of the diaphragm, and a submersible cargo pump being attached to the top of the diaphragm partition in such a manner that it enables liquid cargo from the tank to be pumped to a deck cargo discharge main via a reinforced flexible hose with valving that is attached between a pump discharge flange and a flange in the deck cargo discharge main, thereby providing a means for completely emptying the tank space that is above the diaphragm of cargo liquid.

5. In a diaphragm tank having an impervious diaphragm vertically movable between upper and lower positions within the tank, the improvement comprising diaphragm guide cylinder means secured to an upper surface of the diaphragm and extending upwardly beyond the tank through guide and brake means located externally of the tank, and through gland means at the top of the tank circumscribing the guide cylinder means below the guide and brake means to prevent escape of fluid stored in the tank, the diaphragm guide cylinder means being fitted with a guide cargo washing nozzle, guide inert gas valve, guide vent pipe and guide access opening, in such a manner that the interior of the cylinder can be cleaned, inerted and used for the carriage of cargo.

6. Apparatus according to claim 4, further provided with means whereby cargo liquid can also be loaded by reverse flow through the reinforced flexible hose with valving and then through the submersible cargo pump.

7. Apparatus according to claim 5, wherein the diaphragm is constructed so that the maximum diaphragm travel is from the top of the tank to the bottom and vice versa, thereby allowing maximum advantage to be taken of available tank space for the carriage of fluids and solid cargoes above the diaphragm when it is at the bottom of its travel, and fluid ballast or cargo below the diaphragm when it is at the top of its travel.

* * * * *